United States Patent [19]

Shiokawa

[11] Patent Number: 4,785,173

[45] Date of Patent: Nov. 15, 1988

[54] ELEMENT ANALYZING APPARATUS

[75] Inventor: Yoshiro Shiokawa, Fuchu, Japan

[73] Assignee: Anelva Corporation, Tokyo, Japan

[21] Appl. No.: 23,843

[22] Filed: Mar. 9, 1987

[51] Int. Cl.[4] ..... H01J 49/00

[52] U.S. Cl. ..... 250/309; 250/292; 250/305; 250/306

[58] Field of Search ..... 250/309, 305, 306, 290, 250/292, 296, 281

[56] References Cited

U.S. PATENT DOCUMENTS 4,132,892 1/1979 Wittmaack ..... 250/309
4,652,753 3/1987 Shiokawa ..... 250/281

OTHER PUBLICATIONS

"Energetic Ion Mass Analysis Using a Radio-Frequency Quadrupole Filter", Rev. Sci. Instrum. 49(6), Jun. 1978, pp. 698-706.

Wittmaack, "Improved Secondary-Ion Extraction in a Quadrupole-Based Ion Microprobe," International Journal of Mass Spectrometry and Ion Physics, 43, (1982), 31-39.

G. Slodzian, "Looking at the Collection Efficiency Problem Through the Ion Microscope Optics," NBS Spec. Publ. 427, Workshop on Secondary Ion Mass Spectrometry (SIMS) and Ion Microprobe Mass Analysis Held at NBS, Gaithersburg, Md., Sep. 16-18, 1974, (Issued Oct., 1975).

Pavlyak, et al., "Detection of Hydrogen in Metals by the SIMS-Method with Quadrupole Mass Filter," Japanese Journal of Applied Physics, vol. 16, No. 2, Feb. 1977, pp. 335-342.

*Primary Examiner*—Carolyn E. Fields
*Assistant Examiner*—John A. Miller
*Attorney, Agent, or Firm*—Pollock, VandeSande & Priddy

[57] ABSTRACT

An element analyzing apparatus includes a secondary ion excitation source such as an ion gun, an ion optical system such as an imaging type energy filter and a mass spectrometer. A quadrupole mass spectrometer is used as the spectrometer. The quadrupole mass spectrometer has a construction in relation to $(L \times F)^2 > 0.2$, where L (meter) is a length of a quadrupole of the spectrometer and F (MHz) is frequency. Secondary ions emitted from a sample are accelerated to cause them to pass through the ion optical system and the quadrupole mass spectrometer under a condition with an energy more than a secondary ion energy constant in addition to an energy of the secondary ions emitting from the sample. The first mentioned energy may be ten times or twenty times the secondary ion energy constant. The element analyzing apparatus is capable of effecting the elementary analysis with high sensitivity and accuracy without lowering space resolution.

6 Claims, 2 Drawing Sheets

ELEMENT ANALYZING APPARATUS

BACKGROUND OF THE INVENTION

This invention relates to an element analyzing apparatus for analyzing elements of a sample by mass spectrometry of secondary ions emitted from the sample which is irradiated by ions to excite compositions of the sample.

FIG. 1 schematically illustrates a hitherto used element analyzing apparatus. This apparatus includes an ion gun 1 used as a secondary ion excitation source, an energy filter 2 used as an ion optical system, and a quadrupole mass spectrometer 3. Reference numeral 4 denotes a sample from which trajectories of the secondary ions 7 start. The energy filter 2 consists of an entry aperture plate 21, an exit aperture plate 22 (the numerals 21 and 22 denote the apertures themselves hereinafter), a deflector plate 23 and an energy filter control power source 24. The quadrupole mass spectrometer 3 consists of a quadrupole 31, a quadrupole control power source 32 and a detector 33. The energy filter 2 serves to collect and transport the secondary ions and to remove high-energy ions forming an obstructive background for energy spectra.

FIG. 2 illustrates a typical energy distribution of secondary ions. This holds true in almost all of the elements, for example, B (boron). The energy distribution starting from 0 eV increases to the maximum value of the ion number in the proximity of 10 eV and then progressively decreases to the value near to 10 eV. In this graph, an energy value at a point where its ion number is 1/e times the maximum ion number is referred to herein as "secondary ion energy constant", where e is the base of natural logarithm. Such an energy value Eos is about 20 eV.

This value often varies to 10 eV or 30 eV depending upon combined conditions of the elements. However, the shape of the distribution itself does not change greatly. The secondary ion energy constant Eos is defined as a standard for indicating a degree of extension of the secondary ion energy distribution shown by a decreasing curve similar to an exponential function. The ion energy constant Eos is essential for quantitatively analyzing the mass spectrometer analysis using the secondary ions, as is clear from the explanation hereinafter. Such a standard has been only vaguely considered in the prior art and has not been strictly defined. As can be seen from FIG. 2, the secondary ion included from the energy values 0 eV to the secondary ion energy constant Eos are the majority of the secondary ions emitted from the sample. Moreover, almost all of the secondary ions are included in the range to Eos, that is, twice the secondary ion energy constant.

Moreover, it has been known that the secondary ions 7 emitted from the sample 4 traject in all directions.

In the prior art, the secondary ions hardly accelerate between the sample 4 and the energy filter 2. Therefore, the ion transmission energy between the energy filter 2 and the quadrupole mass spectrometer 3 is substantially equal to the emission energy of the secondary ions. The energy filter 2 of the prior art apparatus exhibits a resolution of approximately 0.2 or less owing to its structural limitation. In other words, the energy filter 2 has an energy transmission range of 0.2 or less times the transmission energy.

In general, moreover, the maximum possible analyzing energy value of a quadrupole mass spectrometer is desired to be as low as possible in consideration of technical difficulty and economy. In the examples of the prior art, therefore, the maximum possible analyzing energy value of a quadrupole mass spectrometer is usually set of 2Eos, that is, twice the secondary ion energy constant or approximately 40 eV or less in commensuration with the secondary ion energy distribution.

The apparatus described above has the following problems.

In the prior art, only a small portion of the secondary ions emitted accidentally toward the entry aperture 21 of the energy filter 2 is collected in the energy filter 2 and detected among the secondary ions 7 emitted from the sample 4 in all the directions as above described. Accordingly, the collecting efficiency of the secondary ions 7 with emitting angular distribution is very low, usually 0.01–0.1.

In the prior art, moreover, only the small portion of the secondary ions having energy values within the transmission energy range of the energy filter 2 is collected in the energy filter 2 and detected among the secondary ions 7 having a wide energy distribution. Namely, the collection efficiency of the secondary ions with the emitted energy distribution is also very low, usually 0.01–0.1.

The sensitivity of the elementary analysis of the prior art apparatus is very due to these problems.

Several examples which are probably related to the invention of the present application are hereby described. There have been reports, lacking in clear documentary descriptions, showing electric potentials of samples being raised to values in the order of 10V for respective particular purposes. In these examples, the sensitivity is further lowered in comparison with the case where the electric potentials are 0 eV. This results probably from the fact that as the secondary ions are accelerated only by values of in the order of 10 eV, the transmission energy in the quadrupole mass spectrometer increases, so as to decrease the energy of the secondary ions which have energy less than the above described maximum analyzing possible energy and are capable of being normally subjected to the mass spectrometry.

In one example of an experiment (Japanese Society for the Promotion of Science, No. 141 committee, material P. 6–P. 11 for No. 43 research meeting), it was reported that when potential of a sample is a few volts, the highest sensitivity obtained is about ten times higher than when the potential of the sample is at zero volt. In this case, however, a gentle potential gradient in close proximity to a surface of a sample has the particular effect of causing the amount of emitted secondary ions to increase. In this example, when the potential exceeds the value corresponding to the highest sensitivity, such a particular effect rapidly disappears so as to lower the sensitivity in conjunction with the reason above described.

The assignee of the present invention proposed in Japanese Patent Application No. 93,609/84 filed on May 10, 1984 that an imaging type energy filter having image observation function between a sample 4 and a quadrupole mass spectrometer be provided, thereby eliminating crater effect and enabling local analysis to be effected. In case that such an imaging type energy filter is located, it is first necessary to delete the influence of chromatic observation for the prior art apparatus, so that energy resolution needs to be improved twice or to the order of 0.1. Therefore, this apparatus encounters a new problem of selecting whether the collection efficiency for the energy distribution is lowered further or space resolution is spoiled.

In this case, moreover, the secondary ions are not accelerated and pass under low energy condition through the ion optical system. Accordingly, a spherical aberration coefficient becomes very large. Such a large spherical aberration coefficient gives rise to a new limitation of space resolution.

With the quadrupole mass spectrometer, moreover, there is inherently an essential disadvantage (fringing effect) in that all ions passing therethrough are not all detected due to potential disturbance at an end of the quadrupole. As is well known, this detrimental effect of the potential disturbance becomes larger as the transmission energy becomes smaller. Therefore, this is a very serious problem for the apparatus of the prior art.

In general, furthermore, there is another problem in that when the transmission energy is small, the ions are susceptible to charge-up resulting from space charge and electrode contamination to lower the efficiency and increase the instability.

In order to solve these problems, there are some apparatuses of the prior art wherein the potential of an energy filter is lowered only at the trajectories of the ions for increasing the transmission energy in the energy filter so as to decelerate the ions immediately before a quadrupole mass spectrometer, thereby restoring the transmission energy in a quadrupole. (This is the case when positive ions are detected. In case of negative ions, the potential is raised. The explanation will concern the positive ions, hereinafter.) Such an apparatus has the possibility of solving part of the above problems. However, the deceleration immediately before the quadrupole causes scattering of the ions, so that quantity of the secondary ions incident onto the quadrupole mass spectrometer and normally subjected to the mass spectrometry is substantially equal to that in the case of no acceleration. Therefore, it does not solve these problems fundamentally. As can be seen from the theorem of charged beam emittance invariability, this is a natural result.

The theorem of emittance invariability will be explained in somewhat greater detail hereinafter, because it is in connection with the effect of the present invention.

The charged beams are inherently of an aggregation of various trajectories. In consideration of a certain sectional surface (which is assumed as axial symmetry), respective trajectories have different positions (which means distances from the axis) and different energies in transverse directions. An area of a closed curve consisting of a collection of points in a phase diagram having two axes of these two quantities is usually referred to as "emittance". A quantitative value of the emittance determines a quality of beams. The smaller the emittance, the better in quality are the beams with short distances from the axis and less energy in transverse directions. According to the theorem of emittance invariability, so long as the energies in axial directions are equal, no matter how beam conditions may be changed, the emittance itself will remain static. This is an important characteristic of the emittance. Namely, even if acceleration and deceleration are effected on the way, and even if diffusion and convergence of beams occur by lenses, so long as the ultimate axial energy is equal to the initial energy, the emittance stays constant even if a shape of a closed curve in a phase diagram is changed. In order to make the emittance small, there is no way other than making the axial energy large by acceleration.

The secondary ions emitted from a sample have different positions corresponding to the analysis zone and different transverse energies corresponding to emitting angle distribution and inherently have a substantially large emittance.

Then, no matter how the secondary ions may be controlled by the use of lenses and the like, so long as the ultimate axial energies or the transmission energies are equal, when diameters or positions of beams are made small, the transverse energies become large. And when the transverse energies are made small, the diameters of the beams become large, so that the emittance stays constant. On the other hand, the quadrupole mass spectrometer does the mass spectrometry normally only for secondary ions among the incident ions which are within ranges as to diameters or position and transverse energies. In order to enlarge the range, it is necessary to increase the impressed voltage and frequency. However, such an increase is so difficult technically that with standard apparatuses where only narrow ranges are employed, only diameters of the order of 4 mm and transverse energies of the order of about 4 eV are possible.

In the apparatus of the prior art described above the emitted secondary ions are accelerated and pass through the energy filter under an energy condition higher than that when emitted. As a result, the emittance becomes small, so that only the energy filter exhibits a high collection efficiency. However, if the secondary ions are decelerated immediately before the quadrupole to original energy values, the emittance returns to its inherent value, so that the number of the secondary ions within ranges to be normally analyzed by the quadrupole mass spectrometer becomes very small, which is ultimately equal to the case of no acceleration. An improvement of the collection efficiency as to the energy distribution and reduction of the charge effect is only expected. However, if the rate of deceleration is too large, an aberration effect resulting from a newly occurring decelerator would delete the above expected improvement.

As can be seen from the above description, these apparatuses of the prior art do not fundamentally solve the above problems.

With this energy filter, the feature of accelerating the secondary ions and decelerating the ions immediately before the quadrupole mass spectrometer has been disclosed in "International Journal of Mass Spectrometer and Ion Physics, 43 (1982) P.31–P.39 (Elsevier Scientific Publishing Company)" and "Detection of Hydrogen in Metals by the SIMS-Method with Quadrupole Mass Filter," Vol. 16, No. 2, February 1977, pp. 335–342 (Japanese Journal of Applied Physics). In these conventional apparatus, the ion trajectory unit of the energy filter is kept at the ground potential, and the center potential of the sample and quadrupole is biased to a higher level. However, there is no difference in their practical effects.

Moreover, there is an example of prior art elementary analyzers using a magnetic sector mass spectrometer (instead of the quadrupole mass spectrometer) to cause secondary ions to pass through an ion optical system and the magnetic sector mass spectrometer under an energy condition higher than that when ions are emitted. In this case, the collection efficiency as to the secondary ion emitting angle distribution is high, but the collection efficiency as to the energy distribution which would obstruct the improvement of sensitivity is considerably lower. This results from the fact that it is necessary to make narrow the energy range of secondary ions passing through the magnetic sector mass spectrometer due to its inherent characteristics and the energy range in the actual apparatus becomes 1-2 eV.

Moreover, there is another example of prior art elementary analyzers using a time of flight mass spectrometer through which ions are caused to pass under an energy condition higher than that when the ions are emitted. In this case, collection efficiencies as to the secondary ion emitting angle distribution and the energy distribution are high. However, the excitation time for the secondary ions must be less than $10^{-7}$ seconds as a single-shot excitation owing to the inherent characteristic of the time of flight mass spectrometer, so that this elementary analyzer could not effect continuous ion detection and therefore the ultimate sensitivity becomes very low.

As above described, the elementary analyzers of the prior art have disadvantages such as low collection efficiency for the secondary ion emission angle distribution and energy distribution, influence of chromatic aberration for the space resolution, influence of fringing effect and charge effect, impossibility of continuous measurement and the like. Accordingly, the elementary analyzers of the prior art do not exhibit sufficient sensitivity and accuracy and could not effect the superior elementary analysis in space resolution.

Particularly, the low sensitivity is a prohibitive disadvantage which could not be eliminated by any means. Such prior art apparatuses could not effect the trace elementary analysis with an impurity limit concentration less than $10^{15}$ atoms/cc in monatomic layers and the local analysis of submicron or quartermicron as lower limitations to be integrated for semiconductor devices. These analyses are very important in the present semiconductor industry. The applicant has already proposed the mass spectrometer capable of analyzing an insulator and of mass-analyzing the secondary ions involving more than two ranges of the secondary ion energy constant, as disclosed in U.S. Pat. No. 4,652,753 issued on Mar. 24, 1987. This prior art mass spectrometer has an arrangement similar to that of the present invention but is based upon the novel idea that it is not necessary to pass the secondary ions through the energy filter and quadrupole type mass spectrometer while these secondary ions are being accelerated, which is in fact implemented in the present invention. Simple, the convention spectrometer spreads the analyzable energy range.

To expand the energy range of the energy filter, the resolution must be set to be high in view of the construction, or the transmission energy must be selected to be high. Moreover, the potential of the energy filter needs to be low even if the potential change caused by charging up the sample is shifted to lower levels (i.e., the polarity opposite to that of the secondary ions). The mass analysis can still be performed. To achieve one of the reliable and simple ways to lower the energy range, as previously described,, the conventional mass spectrometer is arranged in the similar construction to that of the present invention. However, the conventional mass spectrometer must be operated under the different conditions.

SUMMARY OF THE INVENTION

It is a principal object of the invention to provide an improved element analyzing apparatus which eliminates all of the disadvantages in the prior art and which operates with high sensitivity and accuracy sufficient to fulfil the requirements in the present semiconductor industry and is superior in the space resolution.

In order to achieve this object, in an element analyzing apparatus including a secondary ion excitation source, an ion optical system and a mass spectrometer, the mass spectrometer according to the invention is a quadrupole mass spectrometer having a construction fulfilling a relation $(L \times F)^2 > 0.2$, where L is length in meters and has a length of a quadrupole of the spectrometer and F is frequency in MHz, secondary ions emitted from a sample being accelerated to cause them to pass through the ion optical system and the quadrupole mass spectrometer under a condition with an energy more than single secondary ion energy constant in addition to the energy of the secondary ions being emitted from the sample.

In a preferred embodiment, the relation is $(L \times F)^2 > 1$ and the first mentioned energy is more than at least ten times the secondary ion energy constant.

In another preferred embodiment, the first mentioned energy is at least more than twenty times the secondary ion energy constant.

In order that the invention may be more clearly understood, preferred embodiments will described, by way of example, with reference to the accompanying drawings.

DETAILED DESCRIPTION OF PREFERRED EMBODIMENTS

The present invention provides an element analyzing apparatus particularly characterized according to what kind of secondary ion excitation source and its optical system are used, respectively. In the first embodiment, an element analyzing apparatus will be explained using an ion gun as the secondary ion excitation source. When the ion gun is used as the secondary ion excitation source, the analyzing apparatus has a superior capacity of surface analysis of the monatomic layer level of a sample. Moreover, this analyzing apparatus is capable of searching concentration distribution in depth directions with the aid of peeling phenomena at the sample surface caused by the secondary ion excitation. Furthermore, this apparatus can carry out the analysis at a very narrow local portion in transverse directions.

Figure 1:
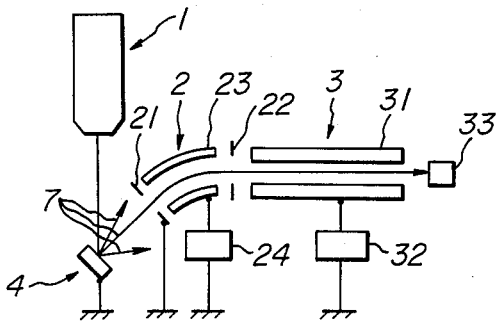
FIG 1 PRIOR ART
FIG. 1 is a schematic view of an element analyzing apparatus of the prior art.
Figure 2:
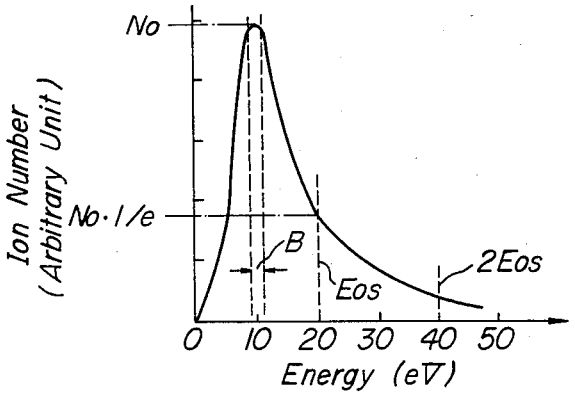
FIG. 2 is a graph illustrating one example of an energy distribution of secondary ions.
Figure 3:
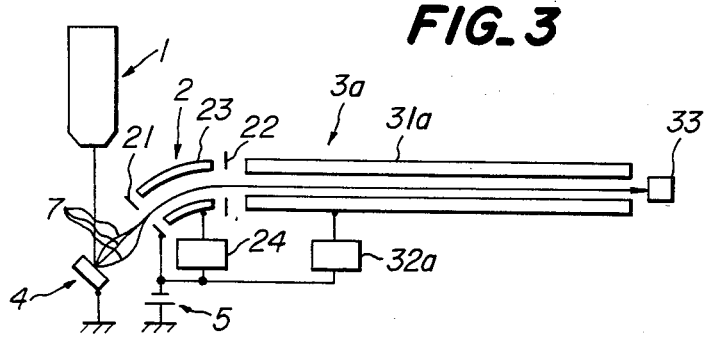
FIG. 3 is a schematic view of an element analyzing apparatus of the first embodiment of the invention.

FIG. 3 illustrates a construction of the first embodiment of the invention, wherein like components have been designated by the same names and same reference numerals as those used in FIG. 1. In this embodiment, a quadrupole mass spectrometer 3*a* is used as a mass spectrometer. This quadrupole mass spectrometer 3*a*, although being the same kind as that shown by the numeral 3 in FIG. 1, is a new type of high performance spectrometer somewhat different in dimension and other factors from that of the prior art, as described later. In order to indicate such differences, the reference numerals are added with a in FIG. 3. A direct power source 5 is newly added to the apparatus according to the invention, which lowers, the potential at the trajectories of the ions in both the energy filter 2 and the quadrupole mass spectrometer 3*a* to a value 200V lower than the potential of the sample in FIG. 2, or, in general, of the order of ten times the secondary ion energy constant Eos, thereby accelerating the ions. Therefore, the transmission energy value in the energy filter 2 and the quadrupole mass spectrometer 3*a* is the energy when the secondary ions are emitted, plus 200 eV. The energy filter 2 has a resolution in the order of 0.2, which is similar to that of a conventional energy filter.

On the other hand, the quadrupole mass spectrometer 3*a* has the maximum possible analyzing energy of the order of 240 eV. This value of the prior art spectrometer is 40 eV. The quadrupole mass spectrometer used in this embodiment of the invention has six times the conventional value to utilize the superior characteristics of the quadrupole mass spectrometer, thereby enabling the continuous mass spectrometer analysis of secondary ions within wide ranges of 0–240 eV.

In consideration that the maximum possible analyzing energy of the quadrupole mass spectrometer is proportional to the square of the length L (meter) and the alternate current frequency F(MHz, MHz$=10^6$ Hertz) to be impressed, either of the L and F or the product $(L\times F)$ is made 2.5 times larger than that in the conventional apparatus. Although detailed explanation is omitted, such an apparatus can be realized. In order to realize such an apparatus, a plurality of quadrupoles are connected in series and used for this purpose. (Refer to Japanese Patent Application No. 112,367/84 filed on June 1, 1984 by the assignee of the present case.) With concrete values, $(L\times F)^2\leqq 0.2$ is in the prior art apparatus, while $(L\times F)^2>1$ is employed in the apparatus according to the invention.

These points will be explained in more detail hereinafter.

A quadrupole mass spectrometer operates by impressing high frequency voltage onto four circular cylinder rod electrodes arranged in parallel with each other, so as to vibrate incident ions at this frequency to cause only ions having particular masses to pass therethrough. In this case, it is known that the number of vibrations required for the mass spectrometry is experimentally indicated in the following relation (1), where M is the mass number of the ion and $\Delta M$ is one half of mass peak value, which is usually 0.5 in order to avoid overlapping an adjacent peak value.

$$n\approx 3.5\,(M/\Delta M)^{0.5} \quad (1)$$

(Refer to "Four electrode spectrometer" 1977, P.13, published by Kodan-sha.)

Moreover, from the uniform motion equation, relation between the length L of the quadrupole, the frequency FMHz and the transmission energy eVi is indicated by the following equation (2)

$$(L\times F)^2=1.9\times 10^{-4}\cdot n^2\cdot Vi/M \quad (2)$$

Now, $\Delta M=0.5$ is assumed, and from this assumption and equations (1) and (2), a relation (3) is obtained.

$$(L\times F)^2\approx 4.7\times 10^{-3}\cdot Vi \quad (3)$$

From the relation (3), when the transmission energy is 40 eV, $(L\times F)^2\approx 0.19$; while when the energy is 240 eV, $(L\times F)^2\approx 1.12$. This is the reason why $(L\times F)^2\approx 0.2$ is set in the prior art where the maximum possible analyzing energy is set at 40 eV or less, while $(L\times F)^2>1$ is set in the apparatus according to the invention where the maximum possible analyzing energy is set at 240 eV.

With the apparatus of the embodiment shown in FIG. 3 constructed as described above, the trajectories of secondary ions 7 emitted from a sample 4 in all directions are attracted to an entry aperture 21 of an energy filter 2 by a large electric potential gradient between the sample 4 and the energy filter 2, so that almost all the secondary ions 7 are collected into the energy filter 2 and pass therethrough. Therefore, the collection efficiency with emitting angle distribution is about 1.

This result has been experimentally ascertained. According to the embodiment, the collection efficiency is improved by more than one figure in comparison with the prior art where the ion is barely accelerated. This improvement of the efficiency is coincident with a result of theoretical calculation.

Consideration of this theoretical calculation will be explained hereinafter. It is assumed that one half of a vertical angle of a cone geometrically formed between an analysis point on a sample and the entry aperture is $\alpha$, and an emitting angle distribution is uniform. Then, the collection efficiency with the emitting angle distribution is a value obtained by dividing an area of a bottom surface of the cone by an area of a hemisphere, which value being indicated in formula by $(1-\cos\alpha)$. In the prior art, it has been attempted to make the value $\alpha$ as large as possible by enlarging a diameter of the entry aperture or shortening a distance between the sample and the entry aperture. However, there is a limitation where the diameter and the distance are substantially equal, resulting from a requirement to ensure the incident position of ion beams. In other words, $\alpha$ is at the most 25°. Therefore, the maximum collection efficiency with the mitting angle distribution without acceleration of the ion is 0.09 which is obtained by substituting $\alpha=25°$ in the above formula $(1-\cos\alpha)$.

In contrast therewith, according to the invention the secondary ions emitted out of the cone between the sample and the entry aperture are attracted into the entry aperture, so that the angle of the actually effective cone is substantially larger than that of the geometric cone.

A relation between these angles of the cones is approximately indicated by the following equation (4), where $\alpha'$ is one half of a vertical angle of the actually effective cone, eVi is the emitting energy of the secondary energy, and eVa is acceleration energy, (refer to Secondary Ion Mass Spectrometry (1975) P. 33, NBS Special Publication 427).

$$\sin\alpha=\{eVi/(eVi+eVa)\}^{0.5}\cdot\sin\alpha' \quad (4)$$

By calculating eVa at the collection efficiency of 1 with the emitting angle distribution directly using the equation (4), the eVa is 184 eV when the collection efficiency is 1 or the angle $\alpha'$ is 90° for all the secondary ions included in those of 2 Eos which is twice the secondary ion energy constant. This value is obtained by solving the equation 4 with respect to eVa, where $\alpha$ is 25° and eVi is 2 Eos or 40 eV. In consideration of errors, therefore, when 200 eV or generally ten times the secondary ion energy constant Eos is applied to the emitted secondary ion, all the secondary ions within 0–2 Eos can be collected which are almost all of the emitted secondary ions.

Then, the collection efficiency with the secondary ion emitting energy distribution in this embodiment will be explained. As the energy passing through the energy filter is at least more than 200 eV, the energy transmission range of the energy filter is more than 40 eV which is a product of the transmission energy (more than 200 eV) and the resolution (0.2). As the energy transmission range of the energy filter is more than 2 Eos, almost all of the secondary ions pass therethrough.

Moreover, as the quadrupole mass spectrometer 3a can continuously analyze the ions having large energy ranges of 0–240 eV and the potential at the ion trajectories is lowered by 200V, all the secondary ions passing through the energy filter are subjected to the mass spectrometry. Namely, the apparatus according to the invention can continuously detect the ions within wider ranges than those normally effected by quadrupole mass spectrometers without causing time losses, so that all the problems in the prior art as described above are solved. In this case, moreover, as the secondary ions are not decelerated, the emittance of the secondary ions in the quadrupole or positions of trajectories and transverse energies remain small as in the energy filter, so that almost all of the secondary ions are normally subjected to the mass analysis. In view of this, the collection efficiency is not lowered.

As described above, according to this embodiment, the collection efficiency with the secondary ion emitting energy distribution is substantially 1. In contrast herewith, according to the prior art, the apparatuses not accelerating ions exhibit energy transmission ranges of at most 2 eV (shown at B in FIG. 2), so that the collection efficiency is very low.

According to this embodiment of present invention, moreover, as the transmission energy is larger by more than one figure, the influences of fringing effect and charge effect in the energy filter and the quadrupole mass spectrometer are considerably reduced relative to those in the prior art.

It has been ascertained in actual experiments that in measurement of secondary ions emitted from various kinds of samples, the sensitivity is improved by 2–3 figures in comparison with apparatuses of the prior art not accelerating secondary ions. In measuring secondary ions of boron with samples of silicon single crystal including the boron (boron concentration, about $3\times10^{16}$ atoms/cc) which is the most usual dopant in the semiconductor industry, $B^+$ ions of $1\times10^5$ could be detected in 0.5 sec. during which about 1/10 of a monatomic layer was being peeled. With these samples, the trace analysis is possible to the order of $10^{13}$ atoms/cc in a monatomic layer.

Figure 4:
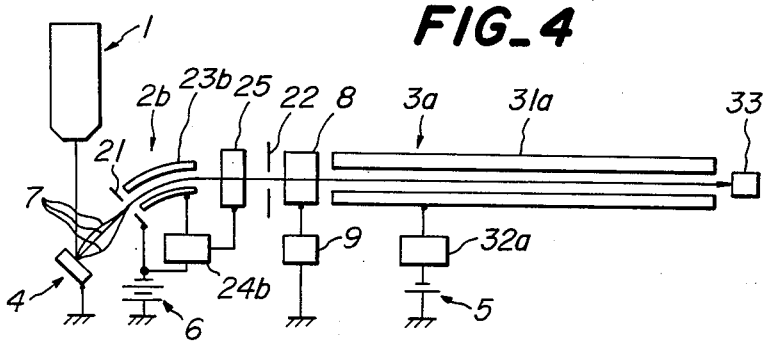
FIG. 4 is a schematic view of an element analyzing apparatus of the second embodiment of the invention.

FIG. 4 illustrates a second embodiment of the invention, wherein an energy filter is different from that of FIG. 3. Therefore, the energy filter is designated by 2b in FIG. 4. The apparatus comprises a newly provided direct current power source 6, a decelerator 8, a decelerator control power source 9, and an imaging lens 25. In this embodiment, the potential of ion trajectories in the energy filter 2b is lower than that of a sample 4 by 400V or twenty times the secondary ion energy constant Eos. On the other hand, the potential of a quadrupole mass spectrometer 3a is lower than that of the sample 4 by 200V or ten times the secondary ion energy constant Eos in the same manner as in the first embodiment. Therefore, the transmission energy in the energy filter is the energy of emitting secondary ions plus 400 eV. On the other hand, the transmission energy in the quadrupole mass spectrometer is the energy of emitting secondary ions plus 200 eV. The decelerator 8 decelerates the secondary ions between the energy filter and the quadrupole mass spectrometer.

The energy filter 2b in this embodiment is of an imaging type and has a resolution of the order of 0.1. The quadrupole mass spectrometer is similar to that used in the first embodiment. The decelerator 8 is of an asymmetrical type and is selected so as to have minimum aberration.

According to this embodiment, the collection efficiency with the secondary ion emitting angle distribution can be substantially 1, similar to the first embodiment. Moreover, as the transmission energy through the energy filter is more than 400 eV, the energy transmission range is 40 eV or more than 2 Eos which is twice the secondary ion energy constant, even if the energy resolution is 0.1. Therefore, the collection efficiency with the secondary ion emitting distribution is substantially 1, like the first embodiment. On the other hand, in view of the space resolution, as the transmission energy of the secondary ions is larger, the chromatic aberration coefficient and the spherical aberration coefficient of the ion optical system are very small. Therefore, the influence of these aberrations is almost negligible which makes it possible to realize good space resolution.

These points will be explained in detail hereinafter.

The secondary ions 7 emitted from the sample 4 form a first imaging surface in front of the imaging lens with the aid of a lens effected as a bipotential lens, resulting from the axial symmetrical electric potential gradient between the sample 4 and the entry aperture 21 to which electric voltage is applied. Moreover, the imaging lens as a unitpotential lens forms a second imaging surface on the face of the exit aperture 22 on an enlarged or contracted scale. At the exit aperture 22, only the ions of part of the image enter the quadrupole to be mass analyzed so as to be locally analyzed. Moreover, while the mass number to be analyzed is kept constant, this second image is scanned to obtain element distribution images.

In such a formation of images, what most affects the aberration is the bipotential lens having a large diverging angle ($\alpha$ described above) of beams or lens portion consisting of the sample and the entry aperture.

Figure 5:
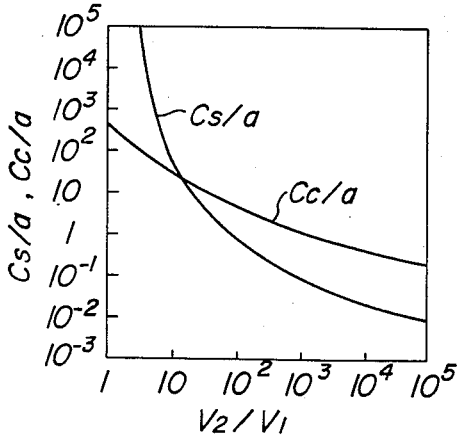
FIG. 5 is a graph illustrating a dependability of the aberrations of bipotential lens upon transmission energy.

The chromatic aberration coefficient and the spherical aberration coefficient of the bipotential lens depend upon a ratio of emitting energy and acceleration energy, aperture diameters distances to the sample, and the like. This is shown in FIG. 5 which is reproduced from "Electron Ion Beam handbook" 1974) P.125 published by Daily Industrial Newspaper Co., where Cc is chromatic aberration coefficient, Cs is spherical aberration coefficient, a is a value when changing rate in electric potential gradient is $\frac{1}{2}$ and $V_1$ and $V_2$ are electrode voltages corresponding to the emitting energy eVi and acceleration energy eVa in this embodiment. As can be seen from FIG. 5, when the ratio $V_2/V_1$ is less than 10 or the acceleration energy is less than ten times the emitting energy, the aberrations rapidly increase. A diffusion due to actual aberrations is obtained from values of the aberrations from FIG. 5 by the use of the following equations (5) and (6).

For chromatic aberration: $Cc \cdot \alpha \cdot \Delta E/E$ (5)

For spherical aberration: $0.5 \cdot Cs \cdot \alpha^3$ (6)

Moreover, $\Delta E/E$ is a value in which the transmission energy is divided by the transmission energy and, in other words, corresponds to the resolution 0.1 in this embodiment.

It is assumed that $\alpha$ is 25° which is a threshold value in the actual apparatus described above and a is 2 mm, which is one half of about 4 mm as the typical exit aperture diameter allowed in the quadrupole in the actual apparatus, and that $V_2/V_1$ is 10 obtained by dividing the acceleration energy ($eV_2=400$ eV) set at twenty times the secondary ion energy constant by the emitting energy ($eV_1=40$ eV) at 2 Eos, which is twice the secondary ion energy constant. With such assumptions, the diffusion value is obtained by the use of FIG. 5 and the equations (5) and (6). The diffusion value due to the chromatic aberration is about 1.5 mm, while the value due to the spherical aberration is about 3 mm. Both the diffusion values are less than the exit aperture diameter 4 mm. Therefore, according to this embodiment of the invention, all the secondary ions from the energy 0 eV to 2 Eos which is twice the secondary ion energy constant can be detected with good space resolution without being influenced by the aberrations.

In this embodiment, the secondary ions, after passing through the imaging type energy filter, are decelerated by the decelerator 8 in order to maintain the maximum possible analyzing energy of the quadrupole mass spectrometer in the order of 200 eV, which is easy to realize. In this process, no detrimental influence of the scattering of the ions would occur. It is correct from the theorem of emittance invariability, because the state of the secondary ions entering the quadrupole is decided by the transmission energy value at the stage ultimately. The collection efficiency with the secondary ion emitting energy distribution and emitting angle distribution in this embodiment is near to 1, which is substantially the same as in the embodiment in FIG. 3 whose transmission energy is also 200 eV. Moreover, the deceleration is carried out from 400 eV to 200 eV, so that no influence of aberrations due to the decelerator would occur. In other words, the apparatus in the second embodiment of the invention is capable of improving the collection efficiency with the secondary ion emitting energy distribution and the space resolution.

As described, the apparatus according to the invention not only improves the collection efficiency with the secondary ion emitting angle distribution and the energy distribution but also reduces the influences of the fringing effect and charge effect. By the synergistic effect of the above improvement and reduction, an improvement of sensitivity $10^2$–$10^6$ over those of the prior art will be achieved. This improvement of sensitivity has been experimentally ascertained.

It was not until the present invention was completed that the trace analysis of the order of $10^{15}$ atoms/cc in monatomic layers and the local analysis of submicron and quartermicron became possible which are very important in the semiconductor industry.

This fact will be explained in more detail hereinafter.

When a sample is irradiated by ion beams, secondary ions together with neutrons are emitted from the sample. A rate of the emission of the secondary ions and neutrons is of the order of $10^{-2}$:1 in general cases except particular elements. The amount of the neutrons is much greater than that of the secondary ions. In the elementary analysis concerning the present invention, therefore, peeling (consumption) of surfaces the of the sample always occurs with the lapse of time for the analysis. This is the reason why such an analyzing method is referred to as "destructive analyzing method". When the number of ions to irradiate are increased or the time for measurement is prolonged to increase the number of secondary ions to be detected in order to improve the sensitivity, the peeling of the sample surface greatly accelerates, thereby making the monatomic analysis impossible.

For example, atoms of the order of $10^{13}$ are arranged side by side on a surface of a sample whose diameter is 1–2 mm, which is an analysis zone in a usual analyzing apparatus. Until the monatomic layer on the surface of the sample has been all peeled by irradiation of ions, secondary ions $10^{-2}$ times of the peeled atoms or of the order of $10^{-11}$ are emitted. In order to ensure the resolution in depth direction corresponding to the monatomic layer, therefore, it is necessary to complete the measurement with the secondary ions until the peeling progresses at least 1/10 or secondary ions of $10^{10}$. With the apparatuses of the prior art whose collection efficiency with the secondary ion emitting angle distribution and energy distribution is less than 0.1, even if secondary ions of the order of $10^{10}$ are given to the apparatus, only secondary ions less than $10^8$ which is $0.1 \times 0.1$ times the secondary ions of $10^{10}$ are actually utilized for the detection. As is well known, it is required to detect at least secondary ions of the order of $10^2$ in order to securely judge presence or absence of elements due to problems of fluctuation and background noise. With the prior art apparatuses, therefore, it is inherently impossible to effect a trace analysis in concentration less than $10^{-6}$ times the monatomic layer of $10^{22}$ atoms/cc, $10^{16}$ atoms/cc or local analysis whose area is less than that having the diameter of 1–2 $\mu$m which is $10^{-6}$ times the diameter of 1–2 mm of the analysis zone with respect to the sensitivity. (Simply, in view of the space resolution, the local analysis less than 1–2 $\mu$m in diameter is impossible.)

According to the invention, however, as the collection efficiencies with the secondary ion emitting angle distribution and energy distribution are both near to 1, almost all of the emitted secondary ions or secondary ions of the order of $10^{10}$ can be detected. It is therefore possible to effect trace analysis of element less than $10^{-8}$ included in the monatomic layer or elements having concentrations of the order of $10^{14}$ atoms/cc or local analysis of elements less than $10^{-8}$ in the monatomic layer or area having a diameter of the order of 0.1–0.2 $\mu$m with respect to both the sensitivity and space resolution.

In the semiconductor industry, it is necessary to control contents of various elements in depth directions at the monatomic layer level and to finely control concentrations of impurities to the lowermost limitation of $10^{15}$ atoms/cc determined in principle and characteristics. However, there has been no means for effecting these controls and the lack of the means forms a great obstruction for this technique. Moreover, it is very important to know the state of the monatomic layer in submicron or quartermicron which is the lower limit of integration of semiconductor devices. However, there has been no means for the analysis for this purpose.

The present invention can carry out the analysis sufficiently fulfill these requirements for the first time, and can eliminate the great obstruction existing in the semiconductor industry.

The above explanation has been concerned with the general elements. It is well known that particular elements such as boron, aluminum, chromium and the like emit a very large amount of secondary ions of the order of $10^{-1}$: 1 which is the ratio of the amount of emitted neutrons. With such particular elements, it is clearly evident from the calculations described above that the present invention is able to do the trace analysis of the order of $10^{13}$ atoms/cc in the monatomic layer and the local analysis of an area having a diameter less than 0.03–0.06 μm as in the embodiments. However, the semiconductor industry does not require such a high performance. Accordingly, when the apparatus according to the invention is used for these particular elements, the apparatus has advantages in cost and technical difficulty by relieving the setting conditions in the first embodiment. Namely, in this case, the collection efficiency of secondary ions of 1/10 of that in the first embodiment is sufficient, so that the value of the acceleration energy can be smaller by the surplus of the collection efficiency. For example, when the acceleration energy is 20 eV or a single secondary ion energy constant Eos, $\alpha'$ is of the order of 45° from the theoretical calculation with the equation (4). The collection efficiency with the emitting angle distribution is of the order of 0.3. The transmission energy range is of the order of 6 eV. The collection efficiency with the emitting energy distribution is also of the order of 0.3. As a whole, the collection efficiency is of the order of 1/10 of that in the first embodiment. In this case, however, eVi is 10 eV or 0.5 Eos which is one half the secondary ion energy constant and the transmission energy is 30 eV which is eVi or 10 eV plus the acceleration energy 20 eV.

In this case, moreover, the maximum possible analysis energy, more than 40 eV, is acceptable, which is the secondary ion energy constant Eos plus the acceleration energy. Accordingly, the quadrupole mass spectrometer, whose quadrupole with a length L in meters from the equation (3) and frequency F in MHz is $(L \times F)^2 > 0.2$, is acceptable.

In the analysis of the particular elements such as boron, aluminum, chromium and the like, therefore, such greatly mitigated conditions sufficiently fulfil the existing requirements in the semiconductor industry.

Although the present invention has been explained referring to the embodiments, the present invention is not limited to the first and second embodiments. For example, in order to make possible the trace analysis of the order of $10^{15}$ atoms/cc and the local analysis in submicron or quartermicron with particular elements having large amounts of emitted secondary ions, such as boron, aluminum, chromium and the like in monatomic layers to an extent contributing semiconductor device manufacturing with clear effect of sensitivity usable for the industry, the energy equal to or more than the secondary ion emitting energy or more than the single second ion energy constant should be given to the ions. The word "single" is used to correspond to the expression "times" the secondary ion energy constant in the above explanation.

Moreover, in order to make possible the trace analysis of the order of $10^{15}$ atoms/cc and the local analysis in submicron or quartermicron with the general elements in monatomic layers to an extent contribution general semiconductor device manufacturing with significant effect of sensitivity, the energy ions more than ten times the secondary ion energy should be given to the ions.

In consideration of the space resolution, in order to bring about the effect of the invention, the energy, more than twenty times the secondary ion energy constant, should be given to the ions. However, as to the transmission energy in the quadrupole mass spectrometer, the ions are decelerated depending upon the required sensitivity and a value added with the energy, more than single secondary ion energy constant or added with the energy more than ten times the secondary ion energy constant, can be selectively used.

In order to obtain large transmission energy, moreover, ion trajectories of the energy filter and the quadrupole mass spectrometer are fixed at earth potential as the conventional manner, and the potential of a sample is raised (lowered in case of detecting negative ions) to achieve the object.

In the above embodiments, the ion optical system using the energy filter capable of selecting the energy has been explained. The ion optical system ins not limited to this type. It may be capable of collecting and transferring ions without selecting ions. The energy filter is not limited to the sector type and may be modified. Moreover, the energy filter may be displaced with or entirely behind the quadrupole mass spectrometer. Furthermore, a separate aperture plate at a substantially equal potential level to the potential of the sample may be arranged in front of the entry aperture plate, in order to improve the collection efficiency with emitting angle distribution or in order to minimize the influence of an electric field about the sample. The decelerator is not limited to the asymmetrical type and may be modified in various manners. Without using the decelerator, the decelerating function may be provided at a distal end of the quadrupole mass semiconductor to achieve the same decelerating effect.

Moreover, although the ion gun as a secondary ion excitation source is used, it is not limited to the ion gun. For example, if a neutral particle gun is used, the analysis of surface can be effected with the sample somewhat high in insulation because beams are not charged beams although focusing of the beams is difficult. Moreover, if a laser gun is used, the analysis of samples of very high insulation is possible because of its optical characteristics although its resolution is of the order of 1 μm in depth directions. If an electron gun is used, only the gas component attached to a surface of a sample is analyzed although its sensitivity is relatively low.

In order to excite the secondary ions, electric discharge, chemical reaction and heating at sample surfaces can be used instead of the beam irradiation. Moreover, the neutrons emitted from a sample may be made into ions by another means for using them as secondary ions. Samples are not limited to solids and may be liquids or gases.

As can be seen from the above description, the element analyzing apparatus according to the invention can effect the elementary analysis with very high sensitivity and high accuracy without lowering the space resolution.

It is further understood by those skilled in the art that the foregoing description is that of preferred embodiments of the disclosed apparatuses and that various changes and modifications may be made in the invention without departing from the spirit and scope thereof.

What is claimed is:

1. An element analyzing apparatus comprising:

a secondary ion excitation source;

an ion optical system;

a mass spectrometer, said mass spectrometer being a quadrupole mass spectrometer having a construction fulfilling a relation $(L \times F)^2 > 0.2$, where L is a length of a quadrupole of the spectrometer and F is a frequency; and means of accelerating secondary ions emitted from a sample and effecting the same to pass through said ion optical system and said quadrupole mass spectrometer under a condition with an energy more than a single secondary ion energy constant in addition to an energy of said secondary ions when emitted from said sample.

2. An element analyzing apparatus as set forth in claim 1, wherein said quadrupole mass spectrometer has a relation $(L \times F)^2 > 1$; and wherein said condition includes an energy at least more than ten times the secondary ion energy constant plus the energy of said secondary ions when emitted from said sample.

3. An element analyzing apparatus as set forth in claim 1, wherein said ion optical system is an imaging type energy filter.

4. An element analyzing apparatus as set forth in claim 2, wherein said ion optical system is an imaging type energy filter.

5. An element analyzing apparatus as set forth in claim 3, wherein said condition includes an energy more than at least twenty times the secondary ion energy constant plus the energy of said secondary ions when emitted from said sample.

6. An element analyzing apparatus as set forth in claim 4, wherein said condition includes an energy more than at least twenty times the secondary ion energy constant plus the energy of said secondary ions when emitted from said sample.

* * * * *

UNITED STATES PATENT AND TRADEMARK OFFICE

CERTIFICATE OF CORRECTION

PATENT NO. : 4,785,173

DATED : November 15, 1988

INVENTOR(S) : Yoshiro Shiokawa

It is certified that error appears in the above-identified patent and that said Letters Patent is hereby corrected as shown below:

Column 2, line 5, change "of" to --at--.

Column 2, line 27, after "very" insert --low--.

Column 2, line 37, delete "of".

Column 6, line 30, after "will" insert --be--.

Column 8, line 10, change "$(LxF)^2 \approx 0.2$" to --$(LxF)^2 \lesssim 0.2$--.

Column 8, line 47, change "mitting" to --emitting--.

Column 9, line 44, after "of" insert --the--.

Column 10, line 44, change "unitpotential" to --unipotential-

Column 10, line 59, after "diameters" insert --,--.

Column 10, line 61, change "handbook" to --Handbook-- and change "1974)" to --(1974)--.

Column 11, line 55, after "described" insert --above--.

Column 12, line 9, change "of surfaces the" to --of the surfaces--.

Column 13, line 6, before "fulfill" insert --to--.

Column 14, line 6, change "contribution" to --contributing--.

UNITED STATES PATENT AND TRADEMARK OFFICE

CERTIFICATE OF CORRECTION

PATENT NO. : 4,785,173

DATED : November 15, 1988

INVENTOR(S) : Yoshiro Shiokawa

It is certified that error appears in the above-identified patent and that said Letters Patent is hereby corrected as shown below:

Column 14, line 28, change "ins" to --is--.

Column 14, line 32, after "with" insert --partially--.

Signed and Sealed this

Twentieth Day of June, 1989

*Attest:*

*Attesting Officer*

DONALD J. QUIGG

*Commissioner of Patents and Trademarks*